US005664814A

United States Patent [19]

Lin

[11] Patent Number: 5,664,814

[45] Date of Patent: Sep. 9, 1997

[54] PORTABLE LOCK

[76] Inventor: Wuchin Lin, P.O. Box 82-144, Taipei, Taiwan

[21] Appl. No.: 661,120

[22] Filed: Jun. 10, 1996

[51] Int. Cl.[6] ..... E05C 19/18

[52] U.S. Cl. ..... 292/288; 292/290; 292/297; 292/296

[58] Field of Search ..... 292/288, 289, 292/291, 297, 298, 290, 258, 296; 24/648, 650, 585

[56] References Cited

U.S. PATENT DOCUMENTS

| | | | |
|---|---|---|---|
| 359,815 | 3/1887 | Sargent | 292/289 |
| 2,461,398 | 2/1949 | Sands | 292/290 |
| 2,506,508 | 5/1950 | Korita | 292/288 |
| 4,330,146 | 5/1982 | Sessions | 292/288 |
| 4,377,887 | 3/1983 | Valestin | 24/585 |
| 4,878,701 | 11/1989 | Rondel | 292/288 |
| 5,033,171 | 7/1991 | Kasai | 24/648 |
| 5,547,236 | 8/1996 | Gregory | 292/288 |

FOREIGN PATENT DOCUMENTS

| | | | |
|---|---|---|---|
| 1556828 | 12/1968 | France | 292/288 |
| 125664 | 5/1927 | Germany | 292/288 |

*Primary Examiner*—Steven N. Meyers
*Assistant Examiner*—Gary Estremsky
*Attorney, Agent, or Firm*—Alfred Lei

[57] ABSTRACT

A portable lock for preventing a door from being opened from the outside. The portable lock has a body formed from two symmetric covers with two spring-biased pivoting handles and a slidable adjustment rod protruding from the assembled body. The adjustment rod has a plurality of holes along its length and an engagement member at an outer end. The engagement member is adapted to engage the strike of a door jamb. The length of the rod is adjusted so as to position the body of the portable door lock firmly against an inner side of the door and jamb. The handles are operated by a user to adjust the length of, and to lockingly engage the adjustment rod with protuberances provided at an inner end of the handles. The portable door lock can be adjusted to different door thicknesses. The handles can be additionally secured against pivoting by the insertion of a U-shaped member into the body of the portable lock.

3 Claims, 8 Drawing Sheets

PORTABLE LOCK

BACKGROUND OF THE INVENTION

1. Field of the Invention

This invention relates to an improved portable lock and in particular to one which can prevent a door from being opened by anyone outside the door.

2. Description of the Prior Art

It has been found that the conventional lock for a door can be easily picked open by a thief thereby rendering it impossible to keep one from intruders. Hence, a portable lock has been developed to obviate this defect. As shown in FIGS. 7 and 8, the portable lock includes two bolts, a body portion and a fixing member. However, it is necessary to turn the bolts and the fixing member into the body portion when desired to lock a door thus making it very inconvenient to use.

Therefore, it is an object of the present invention to provide a portable lock which can obviate and mitigate the above-mentioned drawbacks.

SUMMARY OF THE INVENTION

This invention relates to an improved portable lock.

It is the primary object of the present invention to provide a portable lock which can prevent a door from being opened by anyone outside the door.

It is another object of the present invention to provide a portable lock which is of high security.

It is still another object of the present invention to provide a portable lock which is simple and sturdy in construction.

It is still another object of the present invention to provide a portable lock which is easy and convenient to use.

It is a further object of the present invention to provide a portable lock which is low in cost.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
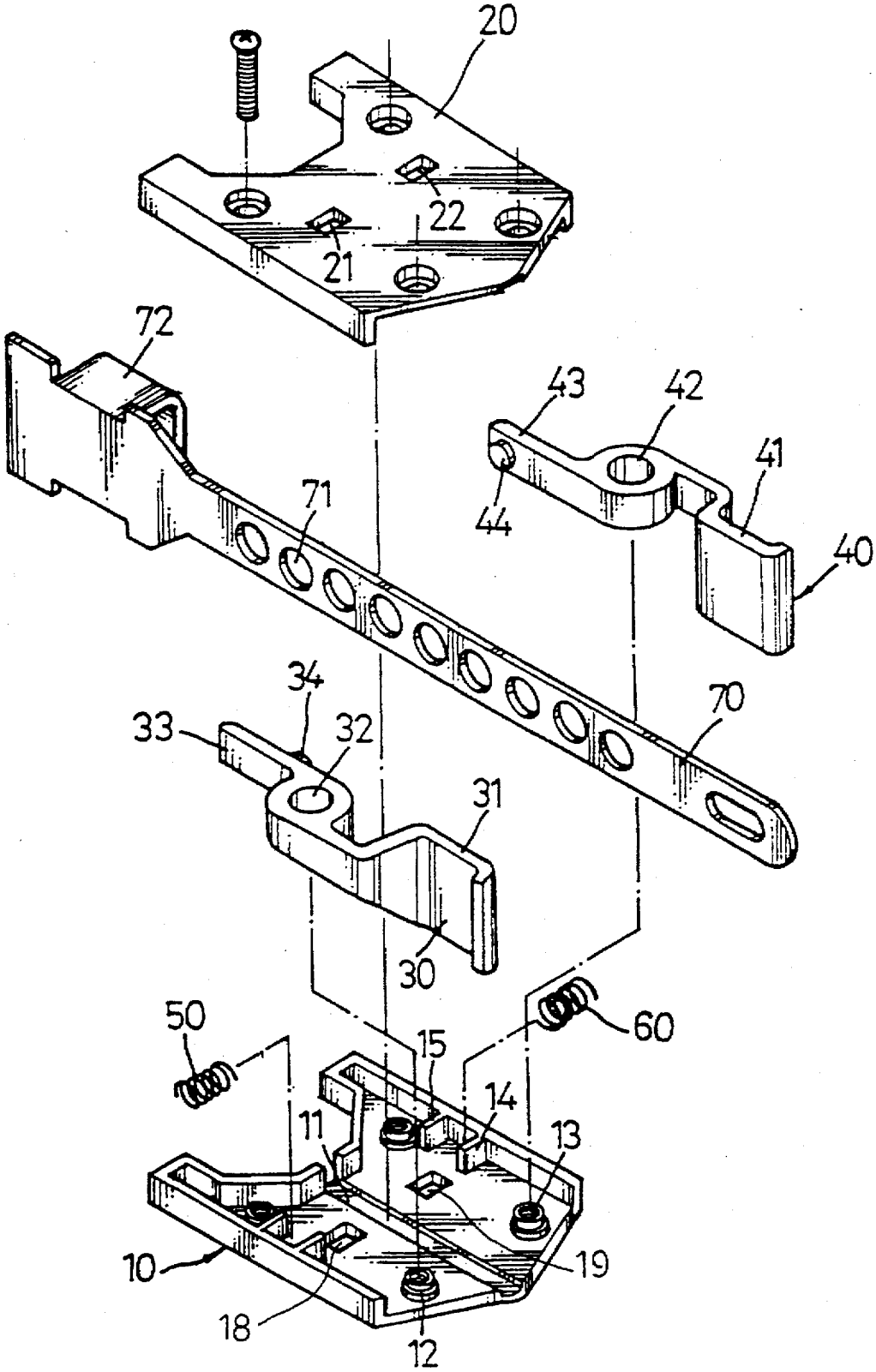
FIG. 1 is an exploded view of a first preferred embodiment according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIG. 1 thereof, the portable lock according to the present invention mainly comprises a body portion and an adjusting rod 70. The body portion includes a lower cover 10, an upper cover 20, a pair of prongs 30 and 40, and two springs 50 and 60.

The lower cover 10 is formed at the intermediate position with a groove 11 extending from one end to another, a plurality of tubular portions 12 and 13 which are provided with internal threads, and two pairs of partitions 14 and 15 forming two chambers. The spring 50 is fitted in a first chamber formed by a first pair of partitions 14 and 15, while the spring 60 arranged in a second chamber between another pair of partitions 14 and 15.

The prongs 30 and 40 are symmetric with each other in structure, which have handles 31 and 41 at one end, through holes 32 and 42 at the intermediate portion, and tail portions 33 and 43 at another end. The tail portions 33 and 43 are provided at the inner side with protuberances 34 and 44, respectively. The prongs 30 and 40 are fitted in the lower cover 10, with the holes 32 and 42 receiving the tubular portions 12 and 13 and the tail portions 33 and 34 pushed against by the springs 50 and 60.

Figure 2:
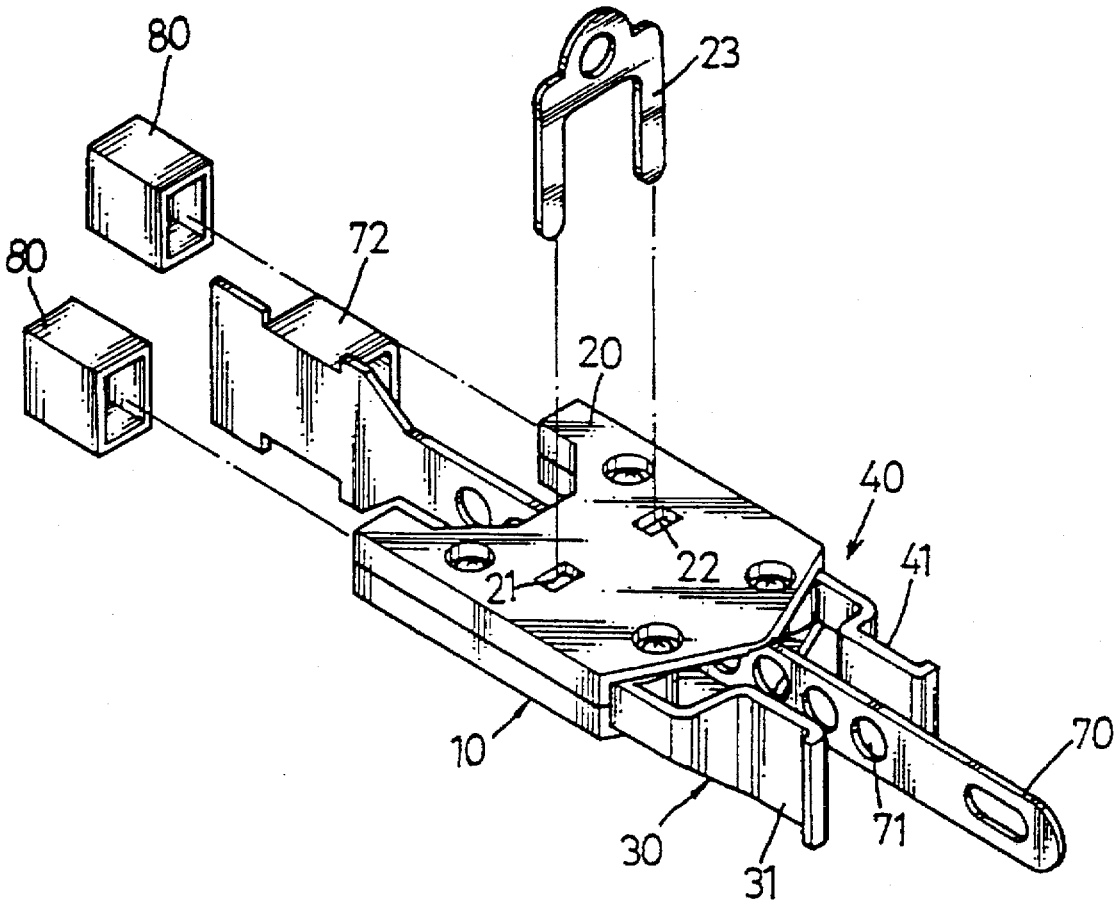
FIG. 2 is an exploded view of a second preferred embodiment according to the present invention.
Figure 3:
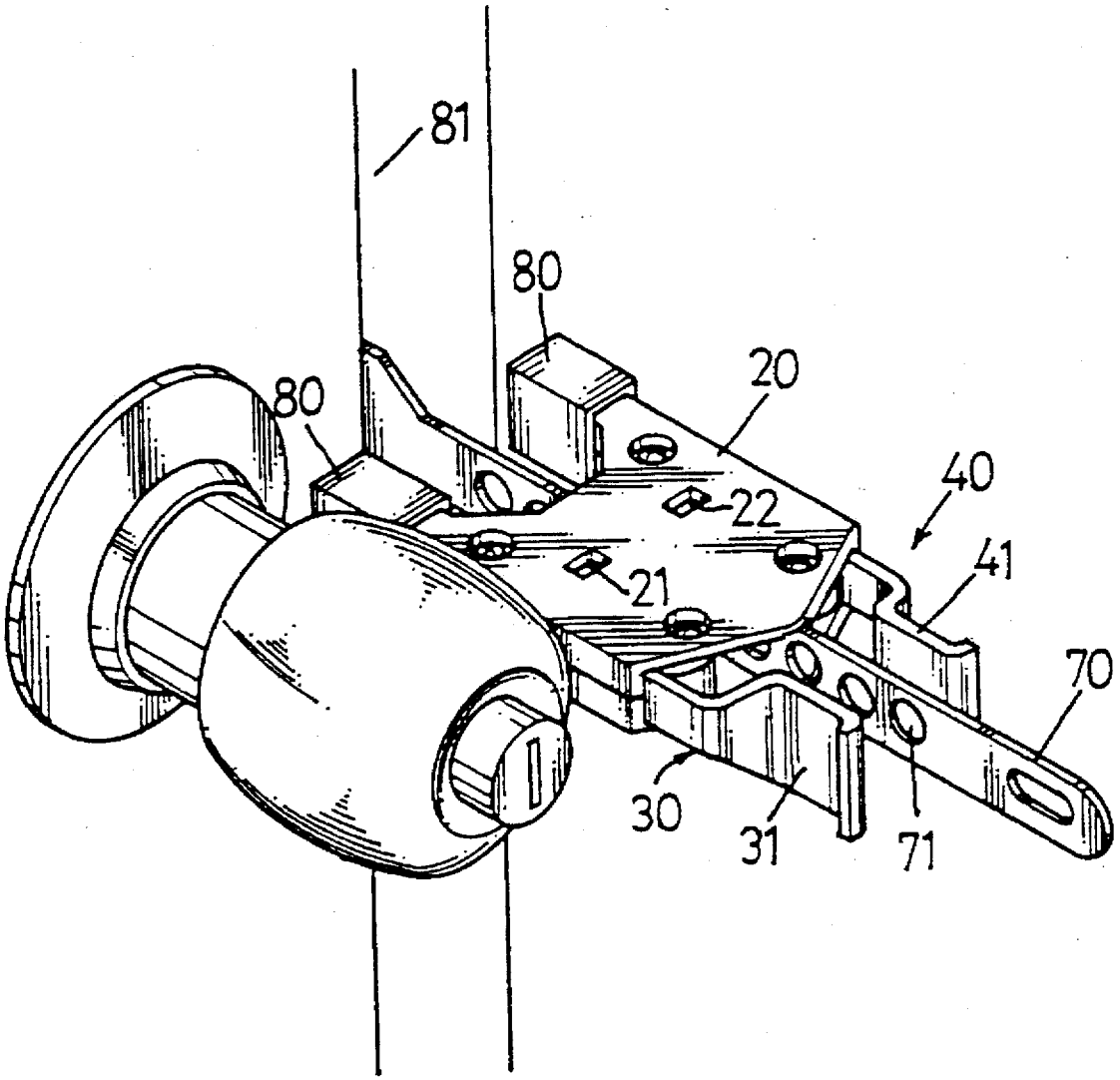
FIG. 3 illustrates how the present invention works.

The adjusting rod 70 extends through the body portion and is slidably fitted in the groove 11 of the lower cover 10 between the two prongs 30 and 40. The adjusting rod 70 has a plurality of equally spaced holes 71 adapted to receive the protuberances 34 and 44 of the prongs 30 and 40. An end of the adjusting rod 70 is provided with a fixing member 72. The upper cover 20 is symmetric with the lower cover 10 in structure and adapted to engage with the top of the lower cover 10 by screws (shown by not numbered). The upper cover 20 has two opposite slots 21 and 22 which are aligned with the slots 18 and 19 of the lower cover 10. An end of the body portion may be engaged with two positioning blocks 80, as required (see FIG. 2). In addition, a U-shaped member 23 may be inserted through the slots 18 and 19 of the lower cover 10 and the slots 21 and 22 of the upper cover 20 (see FIG. 2).

Figure 4:
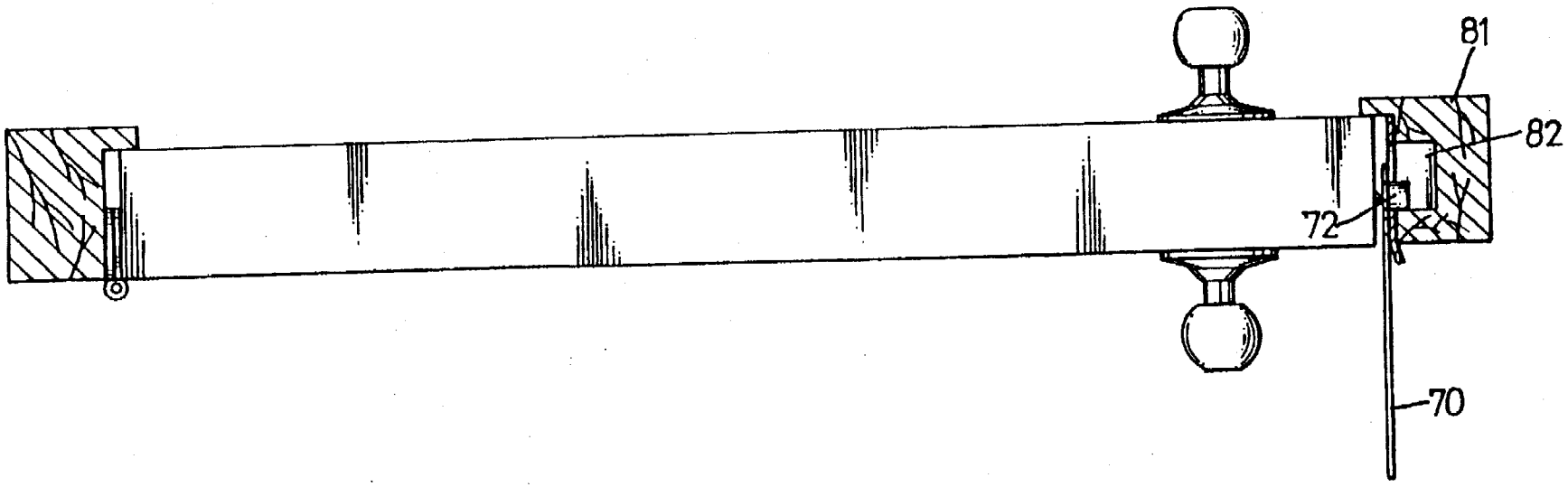
FIGS. 4, 5 and 6 illustrate how to install the present invention on a door.
Figure 5:
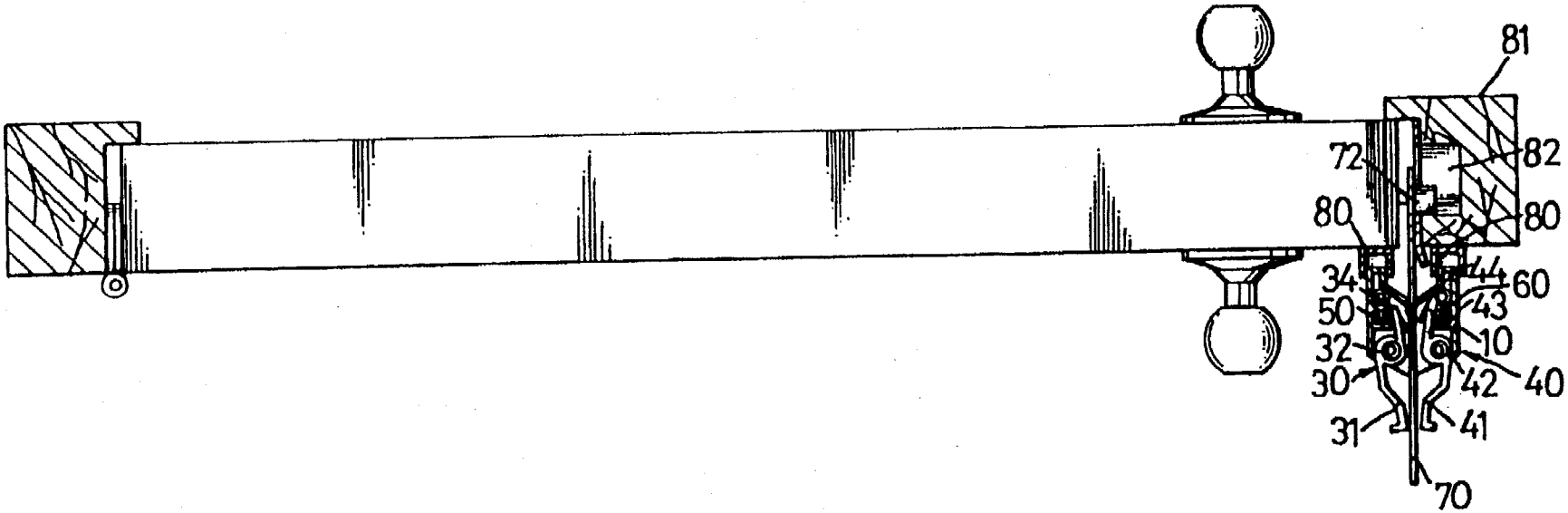
Figure 6:
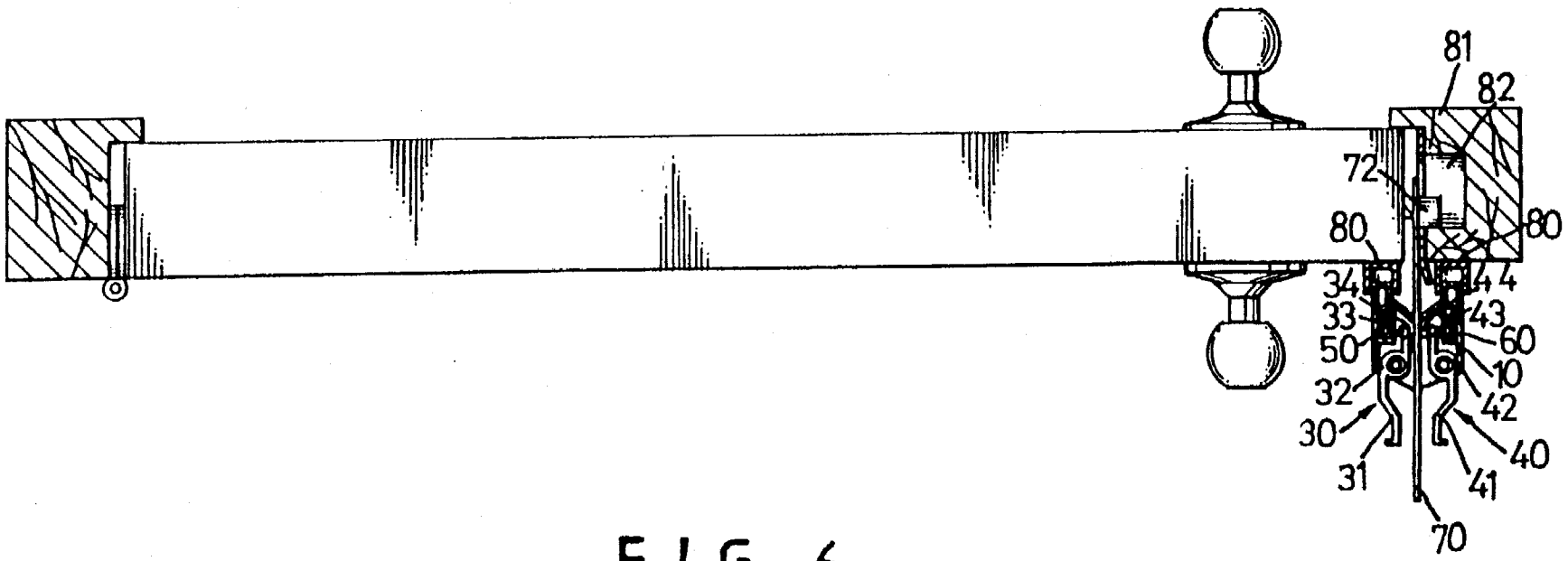
Figure 7:
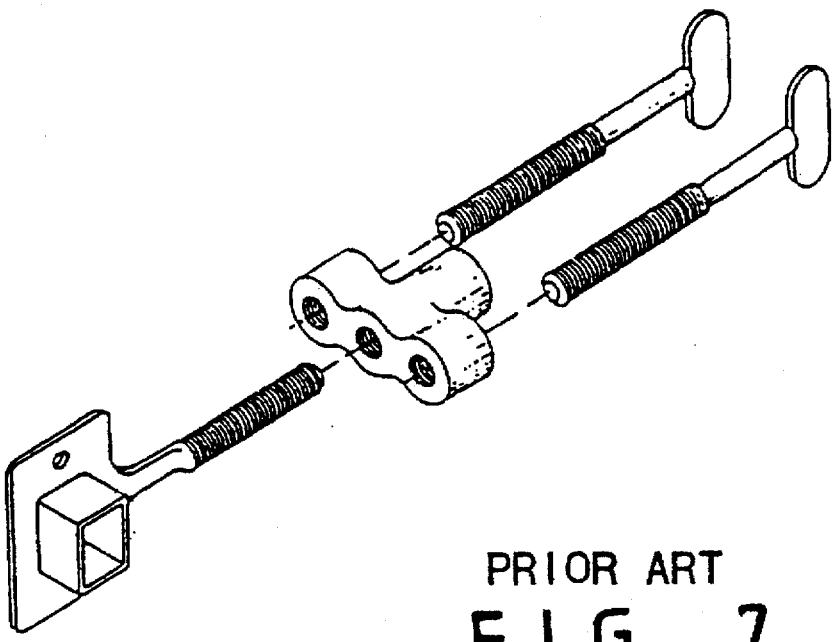
PRIOR ART FIG. 7
FIG. 7 is an exploded view of a prior art portable lock.
Figure 8:
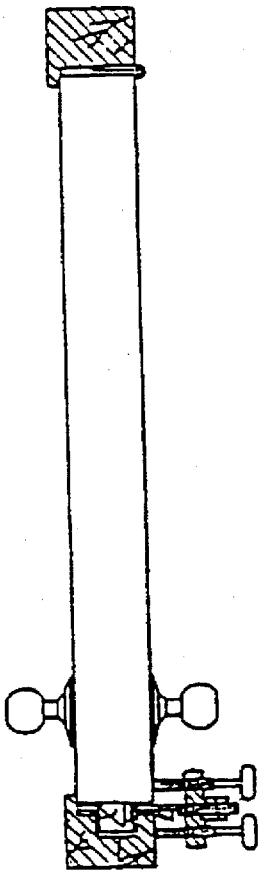
PRIOR ART FIG. 8
FIGS. 8 and 9 illustrate how the prior art works.
Figure 10:
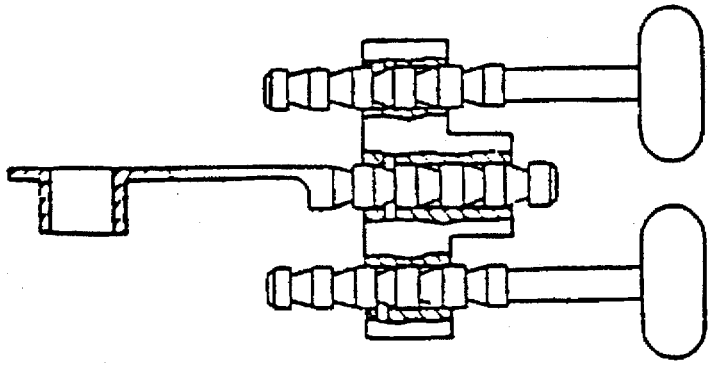
PRIOR ART FIG. 10
FIG. 10 is a top view of the prior art.
Figure 9:
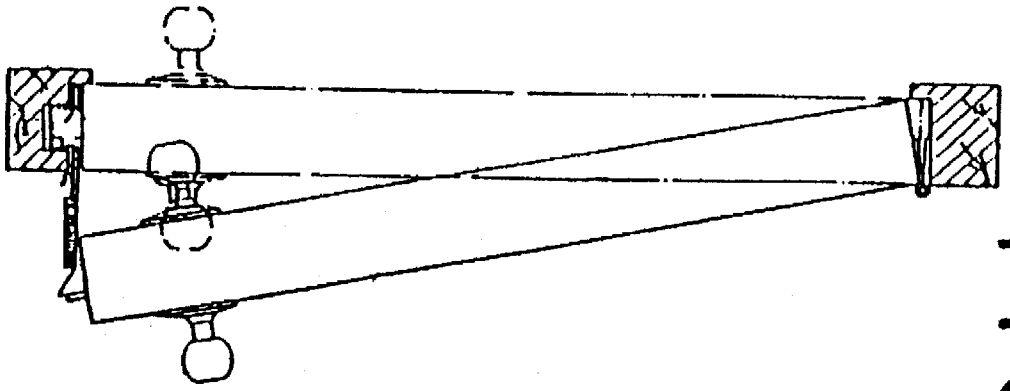
PRIOR ART FIG. 9

When desired to install the portable lock according to the present invention on a door, first fit the fixing member 72 of the adjusting rod 70 into a recess 82 (which is designed for receiving a dead bolt of a lock) of a door frame 81, with the adjusting rod 70 extending inwardly out of the slit between the door frame 81 and the door (see FIG. 4). Then, press the prongs 30 and 40 inwardly and put the body portion on the adjusting rod 70, with the positioning blocks 80 bearing against the door and the door frame 81 (see FIG. 5). Thereafter, release prongs 30 and 40 so that the protuberances 34 and 44 go into corresponding holes 71 of the adjusting rod 70 thereby locking the door and preventing the door from being opened by anyone outside the door.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A portable lock comprising:

a body portion including a pair of covers, a pair of prongs, and two springs, said covers being symmetric with each other in structure, each of said covers being formed at an intermediate portion with a groove extending from one end to another end thereof, a plurality of tubular portions provided with internal threads, and two opposite chambers, said two springs being disposed within said two opposite chambers, said prongs being symmetric with each other in structure and each having a handle at an end thereof, a through hole at an intermediate portion thereof, and a tail portion at another end thereof, said tail portion being provided with a protuberance at an inner side thereof, said prongs being pivotally fitted within said body portion with said through hole rotatably receiving a respective tubular portion and said handle extending out of an end of said body portion and urged outwardly by said springs; and an adjusting rod extending through said body portion and slidably fitted in said groove between said prongs, said adjusting rod being formed with a plurality of holes adapted to receive said protuberances of said prongs and a fixing member at an end thereof.

2. The portable lock as claimed in claim 1, further comprising two positioning blocks connected with an end of said body portion.

3. The portable lock as claimed in claim 1, further comprising a U-shaped member adapted to insert through said body portion.

* * * * *